US005935715A

United States Patent [19]

Ueda

[11] Patent Number: 5,935,715

[45] **Date of Patent: *Aug. 10, 1999**

[54] DRAFT ROLLER FOR FIBERS AND PREPARATION THEREOF

[75] Inventor: Keizo Ueda, Ashiya, Japan

[73] Assignee: Nitto Shoji, Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/816,652

[22] Filed: Mar. 13, 1997

[30] Foreign Application Priority Data

Mar. 29, 1996 [JP] Japan ..... 8-104359

[51] Int. Cl.[6] ..... B32B 25/00

[52] U.S. Cl. ..... 428/426; 428/440; 428/441; 428/492

[58] Field of Search ..... 428/426, 440, 428/441, 492; 427/226

[56] References Cited

U.S. PATENT DOCUMENTS 5,436,083 7/1995 Haluska et al. ..... 428/688

FOREIGN PATENT DOCUMENTS 01203476 8/1989 Japan .
07223867 8/1995 Japan .

OTHER PUBLICATIONS

Translation of JP 07–223867, Aug. 1995, Matsuo.

*Primary Examiner*—Erma Cameron
*Attorney, Agent, or Firm*—Morgan & Finnegan. L.L.P.

[57] ABSTRACT

In a draft roller for fiber, a rubber roller is used as the top roller. A thin amorphous quartz membrane of 0.05 to 5 micron thick is provided on all or part of the surface of the rubber roller to improve both holding of a fiber bundle and abrasion resistance of the rubber surface. It is preferred that the thin quartz membrane contain one or more of carbon black, diamond powder, metal powder or fine olefin tetrafluoride powder in dispersion.

The thin amorphous quartz membrane is formed by applying an organic solvent solution of perhydropolysilazane having a molecular weight of 600 to 1000 on all or part of the surface of a rubber roller, removing the solvent and heating the coated layer.

2 Claims, No Drawings

DRAFT ROLLER FOR FIBERS AND PREPARATION THEREOF

BACKGROUND OF THE INVENTION

The present invention relates to a draft-roller for fibers which is used in a ring spinning frame, a roving frame, a drawing frame, a covering spinning frame and a draw-texturing machine.

For example, in a ring spinning frame, a roving frame, a drawing frame, a covering spinning frame and a draw-texturing machine, a draft-roller in which a rubber roller is used as the top roller set on a metal roller as the bottom roller has been widely used in the process of preparing fibers by draft-twisting cotton sliver, roving or filament to make a fiber bundle into yarn.

A relatively soft rubber material is used as the rubber roller to keep the fiber bundle surely and to get exact draft. Therefore, the surface of the rubber roller is worn severely and it is required to exchange the roller once per several months in consideration of the high speed of preparation and the quality, such as uniformity, of the yarn product.

Here, as such a draft-roller, it is important that the fiber bundles are held surely between the top rubber roller and the bottom metal roller and the abrasion of the rubber surface due to passage of fibers is made minimum as far as possible.

The object of the present invention is to improve the draft-roller for fibers which comprises such a rubber roller to achieve superior holding of a fiber bundle and abrasion resistance of the rubber surface.

SUMMARY OF THE INVENTION

According to the present invention, the above problem has been solved by coating a thin amorphous quartz membrane of 0.05 to 5 microns thick on all or part of the surface of a soft rubber roller.

For example, the above thin amorphous quartz membrane can be formed by applying an organic solvent solution of perhydropolysilazane having a molecular weight of 600 to 1000 on all or part of the surface of a relatively soft rubber roller having a rubber hardness of 60° to 80° according to Japanese Industrial Standard JIS K 6301 and then removing the solvent and heating it in air (usually at 120 to 180° C.). As the above solvent, suitable are hydrocarbons of high polarity such as toluene, xylene, cyclohexane and the like.

DETAILED DESCRIPTION OF THE INVENTION

In this case, improvement in practical performances such as durability of the rubber roller surface, prevention of static electricity and prevention of adhesion of fiber impurity can be attained by using a coating solution in which carbon black, industrial diamond powder, metal powder or fine tetrafluorinated olefin is mixed and dispersed in the polysilazane solution if required.

The quartz membrane of the present invention is rich in bending resistance as it is amorphous. The thickness is preferably 5 microns or less, particularly 0.5 to 3 microns. In this case, it has been found that it has a bending resistance for repeated deformation of 5 mm diameter.

As to abrasion resistance, the haze value of a membrane thickness of 0.5 micron in a steel wool abrasion test of steel #000 at a load of 250 g for 60 rpm was 1.8 and it was confirmed to be far superior to the haze value of 8.2 for the rubber surface.

Furthermore, as shown in the Examples below, the present invention utilizes the contact angle to carbon, metal or tetrafluorinated olefin which is a feature of amorphous quartz and the chemical reaction of reducing a small amount of oxide membrane present on the particle surface by dispersing and incorporating carbon black, diamond particles, aluminum powder and/or fine tetrafluorinated olefin particles in the amorphous quartz membrane to improve highly the abrasion resistance of roller surface, characteristically to remove the static electricity, and to prevent adhesion of fiber impurities such as animal and vegetable oil, honeydew cotton or oligomers in addition to the holding of fiber bundles and improvement in abrasion resistance.

The amount of diamond particles and the like dispersed in the amorphous quartz membrane is usually in range of 5 to 25 weight % and preferably 10 to 20 weight %.

PREFERRED EMBODIMENTS OF THE INVENTION

The following examples serve to illustrate the invention in more detail although the invention is not limited to the examples. In the examples, the rubber hardness is measured by the JIS K 6301 spring type hardness test (type C).

EXAMPLE 1

A roller of a hardness of 76° made mainly of nitrile rubber as the top roller equipped to a spinning frame was immersed in xylene to wash the surface. Then, 20% xylene solution of perhydropolysilazane having a molecular weight of 800 (Tonen Polysilazane PHPS-1 manufactured by Tonen Corporation) was applied on the roller under rotation (300 rpm) and dried at 76° C. for 10 minutes and then heated in a hot air oven at 150° C. for 30 minutes to coat an amorphous quartz membrane of 0.8 micron thick on the roller surface.

The surface hardness of the resultant roller was 76° which was substantially the same as before it was coated. However, when equipped to the spinning frame and rotated in feeding cotton roving, the uniformity of yarns was improved, compared to the case of using a roller not coated, and abrasion of the roller surface was not observed even after 6 months continuous operation. Thus, coating was found to highly improve the abrasion resistance.

EXAMPLE 2

Aluminum powder of 320 mesh was mixed and dispersed in 10% xylene solution of perhydropolysilazane having a molecular weight of 950 (Tonen Polysilazane PHPS-2 manufactured by Tonen Corporation) in a weight ratio of 20% based on the polysilazane weight to prepare a coating solution.

A silicone rubber roller of a hardness of 60° was cleaned and degreased by xylene to prepare a front roller for a drawing frame. The above coating solution was applied on the roller and desolvented in a dryer at 100° C. and then heated in a hot air oven at 150° C. to form an amorphous quartz membrane of average 1.5 micron thick containing aluminum powder on the roller surface.

The resultant roller had a surface hardness of 72° and no substantial change in rubber hardness was, compared to that prior to coated. However, uniformity of the fiber sliver was obtained by a roller pressure of 8 kg lower than the usual roller pressure of 10 kg. In addition, no surface abrasion was observed even after continuous operation for three times longer period compared to the roller before coated.

EXAMPLE 3

A top roller (rubber hardness of 80°) of a take-up portion for extending and twisting spun polyester filament was cleaned and degreased by xylene.

Then, with 10% xylene solution of perhydropolysilazane having a molecular weight of 1200 (Tonen Polysilazane PHPS-2 manufactured by Tonen Corporation), fine powder of tetrafluorinated propylene in a weight ratio of 10% based on the polymer and the same amount of diamond powder were mixed to prepare a coating solution.

The above roller was rotated in the coating solution to apply the coating solution on its surface and then heated at 100° C. to desolvent it and then heated in a hot air oven at 150° C. for 30 minutes.

The resultant top roller had a coating of amorphous quartz membrane 1.5 microns thick containing tetrafluorinated resin particles and carbon particles on the surface. When equipped to a draw-texturing machine to extend and twist a polyester filament (multifilament of 40 denier formed by 16 filaments) at a rate of 2000 m/min, no abrasion was observed, nor adhesion of polyester oligomer and oil solution on the roller surface, even after 24 hours operation.

The draft-roller for fiber bundle according to the present invention is excellent in both holding of fiber bundles and surface abrasion resistance. It can be used efficiently and stably for a longer period than conventional draft-rollers.

Furthermore, the draft-roller of the present invention, in which carbon black and metal powder are dispersed and contained in the amorphous quartz membrane, shows a vast improvement in abrasion resistance of the roller surface and also is excellent in removal of static electricity and prevention of contamination.

What is claimed is:

1. A drafting rubber roller which is used as a top roller set on a metal roller to make a fiber bundle into yarn between said rubber roller and said metal roller, characterized in that said rubber roller is a soft rubber roller having an outer surface, a rubber hardness of 60° to 80°, and having a thin amorphous quartz membrane provided on at least a portion of said outer surface, said amorphous quartz membrane being formed by heating an organic solvent solution of perhydropolysilazane, said membrane having a thickness of 0.05 to 5 microns thick.

2. A drafting rubber roller according to claim 1, in which said thin quartz membrane is formed by heating an organic solvent solution of perhydropolysilazane of molecular weight 600–1200.

* * * * *